United States Patent [19]

McBride et al.

[11] Patent Number: 5,064,084

[45] Date of Patent: Nov. 12, 1991

[54] COMPOSITE CLOSURE WITH SEAL PROPORTIONING LIP

[75] Inventors: Stephen W. McBride, Brownsburg; Ralph Whitney, Indianapolis, both of Ind.

[73] Assignee: H-C Industries, Inc., Crawfordsville, Ind.

[21] Appl. No.: 572,868

[22] Filed: Aug. 27, 1990

[51] Int. Cl.[5] ..... B65D 53/04

[52] U.S. Cl. ..... 215/350; 215/343; 215/341; 215/252

[58] Field of Search ..... 215/341, 343, 345, 350, 215/329, 252, 246

[56] References Cited

U.S. PATENT DOCUMENTS

| | | | |
|---|---|---|---|
| 4,076,152 | 2/1978 | Mumford . | |
| 4,343,754 | 8/1982 | Wilde et al. . | |
| 4,378,893 | 4/1983 | Wilde et al. . | |
| 4,396,134 | 8/1983 | Owens . | |
| 4,407,422 | 10/1983 | Wilde et al. . | |
| 4,415,095 | 11/1983 | Schweigert et al. . | |
| 4,475,274 | 10/1984 | Beckstrom et al. . | |
| 4,493,427 | 1/1985 | Wolkonsky . | |
| 4,497,765 | 2/1985 | Wilde et al. . | |
| 4,527,705 | 7/1985 | Prades | 215/252 |
| 4,566,603 | 1/1986 | Moore . | |
| 4,591,063 | 5/1986 | Geiger . | |
| 4,664,280 | 5/1987 | Whitney et al. | 215/350 |
| 4,674,642 | 6/1987 | Towns et al. | 215/230 |
| 4,705,183 | 11/1987 | Moloney . | |
| 4,978,017 | 12/1990 | McBride | 215/252 |
| 4,984,703 | 1/1991 | Burzynski | 215/350 |
| 5,004,112 | 4/1991 | McBride | 215/252 |

FOREIGN PATENT DOCUMENTS

| | | | |
|---|---|---|---|
| 1104964 | 5/1986 | Japan | 215/343 |
| 81/00838 | 4/1981 | World Int. Prop. O. | 215/350 |

*Primary Examiner*—Stephen Marcus
*Assistant Examiner*—Stephen Cronin
*Attorney, Agent, or Firm*—Dressler, Goldsmith, Shore, Sutker & Milnamow, Ltd.

[57] ABSTRACT

A composite closure with a side seal proportioning lip is disclosed, with the closure including an outer plastic closure cap, and a plastic sealing liner positioned adjacent a top wall portion of the cap. The sealing liner includes a central disc-shaped portion, and an integral relatively thick, annular sealing bead portion. The closure is thus configured to effect a "top/side seal" with an associated container. The construction includes an annular liner-retaining lip having a relatively flexible annular inner edge portion which coacts with the sealing bead portion of the liner to self-adjust and proportion the degree of sealing engagement between the sealing bead portion of the liner and the associated container.

10 Claims, 2 Drawing Sheets

COMPOSITE CLOSURE WITH SEAL PROPORTIONING LIP

TECHNICAL FIELD

The present invention relates generally to closures which can be sealingly fitted to bottles and like containers, and more particularly to a composite closure including an outer plastic closure cap, and an inner plastic sealing liner, with the cap including a deflectable lip which can deform the sealing liner to obtain the desired sealing engagement with an associated container.

BACKGROUND OF THE INVENTION

Packaging arrangements including a bottle or a like container, and an associated closure fitted thereto, are suitable for a wide variety of goods, in particular liquids such as beverages. In this regard, economical and effective closure constructions for containers including carbonated beverages, wherein the contents are pressurized, have proven challenging to perfect.

U.S. Pat. No. 4,378,893, to Wilde, et al., discloses a composite closure construction which has proven to be very commercially successful due to its high degree of suitability for use on containers having pressurized contents. This construction includes an internally threaded, outer plastic closure cap, with a sealing liner fitted in the closure cap adjacent to a top wall portion thereof. U.S. Pat. Nos. 4,343,754 and 4,497,765 disclose methods and apparatus for effecting efficient manufacture of this type of closure.

One particularly advantageous feature of this type of closure is the nature of its sealing arrangement. Specifically, the generally disc-shaped sealing liner of the closure includes an annular sealing bead portion which defines a generally inwardly facing sealing surface. By this arrangement, a so-called "top/side" seal is formed with the associated container, that is, sealing engagement is effected at both the upwardly facing top surface, and outwardly facing side surface of the container.

Experience has shown that the internal gas pressure of a container having a carbonated beverage or the like can act against the inside of the top wall of this type of closure, thereby acting to deform or bow the top wall upwardly. While this cold-flow phenomenon (sometimes referred to as "creep" of the plastic material) can lessen the sealing engagement of the closure with the top surface of the container, the combination top/side seal assures that the side seal is maintained, thus maintaining the sealing integrity of the construction.

Despite the desirable functional characteristics of this construction, certain conditions can detract from its effectiveness. One potential problem concerns the inevitable manufacturing tolerances encountered in container manufacture, wherein a closure may be fitted to either a relatively small or relatively large container. Similar containers made from different materials may also exhibit dimensional differences in their finishes.

The side seal of the closure is generated by compression of the liner material at the inside diameter of the annular sealing bead portion when the closure is applied to a bottle finish. The amount of liner compression is determined by the outside diameter of the bottle finish relative to the inside diameter of the sealing bead portion.

To form an effective seal, the relatively low compression of the liner material at the side seal by a smaller diameter bottle requires that the length (i.e., height) of the side seal be relatively long. In contrast, high compression of the liner material by a relatively large diameter bottle only requires a short side seal length to assure the desired sealing.

Accordingly, it is desirable to provide an arrangement which is configured to change the side seal length depending upon the finish diameter of the container to which the closure is fitted.

In addition to providing the desired degree of sealing engagement between the closure and the associated container, a closure should preferably be configured to facilitate high-speed, automatic application. As noted, a container having a relatively large outside diameter results in relatively high compression of the liner material attendant to closure application, and providing an arrangement which facilitates such application is desirable.

One undesirable result of the compression of the closure liner material can be an extrusion-like deformation of the material so that it tends to move past the annular retaining lip down the side wall of the bottle finish. This can have the undesirable effect of increasing the so-called vent release angle of the closure. Specifically, for threaded closures used on carbonated beverages, it is ordinarily desirable to facilitate the venting of gas pressure from within the container prior to release and disengagement of the closure threads. Under those conditions where the liner material has extruded past the retaining lip, the angle through which the closure must be rotated to release the seal, and thus initiate venting, can be undesirably increased, thereby decreasing the amount of rotation between initiation of venting and disengagement of the threads. Accordingly, it is desirable to minimize such extrusion of the liner material past the retaining lip.

Finally, it is generally desirable to enhance the efficiency of closure manufacture. As disclosed in the above-noted patents, closures of the subject type are formed by in situ compression molding of the liner material by depositing a pellet of molten plastic in the closure cap, and thereafter compressing and molding the molten material so that it flows against the annular liner retaining lip and forms the sealing liner.

To assure that the lining material is confined generally within the region defined by the annular lip, the use of an annular sleeve, which fits about the liner-shaping molding plunger, is preferred. This annular sleeve engages the annular lining retaining lip as the liner material is molded, thereby acting to confine the material as desired.

Problems can arise when attempting to line relatively hot and pliable closure caps. Experience has shown that under these conditions, the liner material can be forced past the relatively pliable retaining lip of the closure cap, resulting in plastic "flash" around the lip. This is undesirable because it can undesirably increase the vent release angle of the closure, and detracts from the aesthetic aspects of the construction.

With consideration of the above design problems, the present closure has been particularly configured to provide the desired degree of sealing for closures exhibiting varying diameters within normal tolerances, while at the same time providing consistent venting characteristics. High-speed manufacture and application are desirably accommodated.

SUMMARY OF THE INVENTION

In accordance with the present invention, a composite closure is disclosed which includes an outer plastic closure cap having an annular liner-retaining lip, and a plastic sealing liner positioned adjacent a top wall portion of the closure. Notably, the annular lip of the closure cap is configured to deform the sealing liner to thereby provide a self-adjusting or self-proportioning cooperation with the liner attendant to application to a container, whereby the degree of sealing engagement with the associated container is automatically varied. At the same time, the configuration of the lip promotes high-speed application by acting to guide the closure onto the container, with the arrangement further facilitating consistent high-speed manufacture and lining of the closure.

The composite closure of the present invention includes a plastic outer closure cap having a top wall portion, an annular skirt portion depending from the top wall portion, and an annular liner-retaining lip which projects inwardly from the annular skirt portion in closely spaced relation to the top wall portion. In the illustrated embodiment, the skirt portion includes an internal thread formation, and a plurality of axially extending vent grooves to facilitate the release of gas pressure when the closure is fitted to a container having carbonated contents.

The closure further includes a plastic sealing liner positioned adjacent the top wall portion which is retained in the closure cap by the annular lip. The sealing liner is preferably compression molded in situ to a disc-shaped configuration, and includes an annular sealing bead portion positioned adjacent the annular lip. The annular sealing bead portion defines a generally inwardly facing sealing surface, with the liner thus configured to provide a so-called top/side seal with an associated container. The side sealing action is provided by the engagement of the inwardly facing sealing surface of the bead portion with the associated container.

In accordance with the present invention, the annular lip of the closure cap is configured to coact and cooperate with the annular bead portion of the liner to provide a self-adjusting or self-proportioning action. Specifically, the annular lip is deflectable so as to deform the annular sealing bead portion of the liner, and thereby proportion the degree of sealing engagement of the inwardly facing sealing surface of the bead portion with the associated container. This effect is achieved by configuring the annular lip to include a relatively flexible and deflectable inner edge portion which can move and flex under the influence of a container having a sufficiently large diameter so as to engage this portion of the annular lip.

In the illustrated embodiment, the annular lip further includes a relatively inflexible base portion positioned adjacent the skirt portion of the closure cap, with the deflectable inner edge portion extending inwardly of the base portion. By deflection of the inner edge portion relative to the skirt portion of the closure, the bead portion of the sealing liner is deformed. In this manner, a relatively large container (which subjects the liner to high compression) acts to deform the liner and shorten the length of the side seal, while a relatively smaller container (which subjects the liner to relatively low compression) subjects the lip to little or no deflection, whereby a relatively long side seal is formed.

In the preferred form, the annular lip of the closure cap facilitates high-speed closure application. To this end, the lip defines an annular guide surface facing generally away from the top wall portion of the closure, with this surface acting to guide the closure onto the container for sealing engagement of the inwardly facing sealing surface with the container. In the illustrated embodiment, this guide surface is provided on the deflectable, inner edge portion of the annular lip, and is of a frusto-conical configuration so that the surface converges inwardly toward the top wall portion of the closure.

To further facilitate application, the sealing liner of the closure preferably defines a frusto-conical annular surface which extends between the free edge of the deflectable inner edge portion of the annular lip, and the inwardly facing sealing surface of the bead portion of the liner. In the preferred form, this annular surface of the liner converges inwardly toward the top wall portion at the same angle as the guide surface of the annular lip, and is preferably adjacent and abutting to the lip guide surface so that the annular surface of the liner is a continuation thereof. In the most preferred form, the two frusto-conical annular surfaces collectively define a generally continuous frusto-conical surface, which acts in a ramp-like fashion to guide the closure onto the container and establish the desired sealing engagement between the inwardly facing sealing surface of the liner and the container.

Other features and advantages of the present invention will become readily apparent from the following detailed description, the accompanying drawings, and the appended claims.

DETAILED DESCRIPTION

Figure 1:
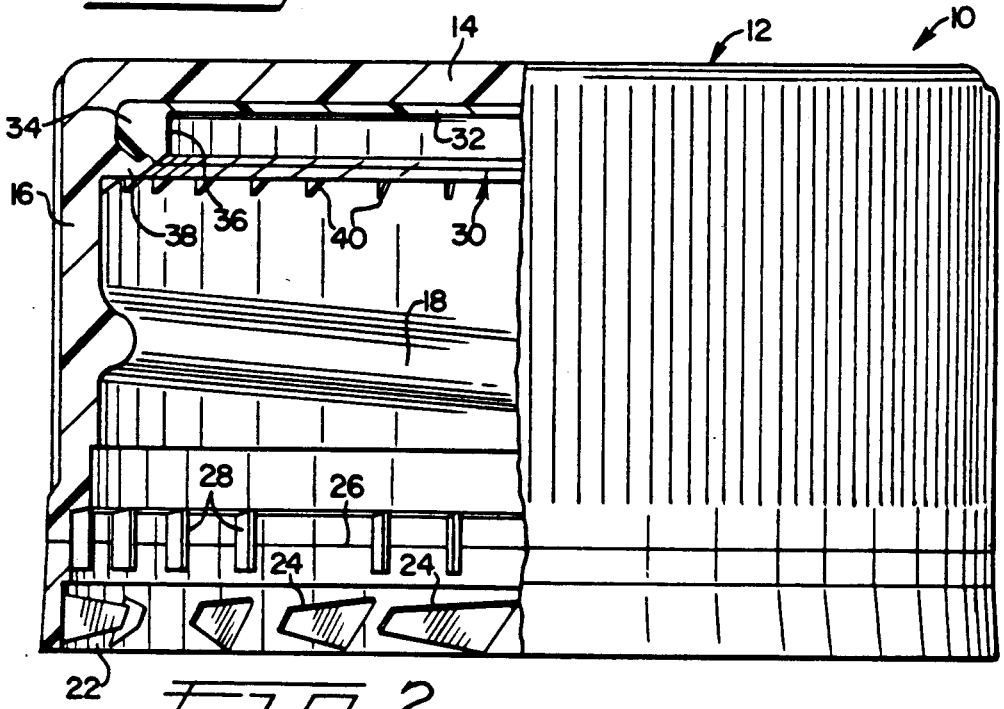
FIG. 1 is a side elevational view in partial cross-section of a composite closure embodyinq the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to FIG. 1, therein is illustrated a composite closure 10 embodying the principles of the present invention. As will be further described, the closure 10 is particularly configured for use in connection with an associated container C, such as a bottle or the like, and is particularly effective for use with carbonated beverages or like pressurized contents.

A composite closure embodying the present invention may be formed in accordance with the teachings of U.S. Pat. Nos. 4,343,754 and 4,497,765, which are incorporated herein by reference. In accordance with the teachings of these patents, composite closure 10 can be efficiently formed by compression molding, including compression molding of the outer plastic closure cap, and in situ compression molding of the sealing liner of the construction.

In the illustrated embodiment, closure 10 includes a generally cup-like plastic closure cap or shell 12 having a circular top wall portion 14, and a cylindrical, annular skirt portion 16 depending from the top wall portion. Skirt portion 16 is preferably provided with an internal thread formation 18, which is configured to mate with a like thread formation on an associated container C.

In the illustrated embodiment, the closure 10 includes a tamper-evident feature, comprising an annular pilfer band 22 depending from skirt portion 16. The pilfer band includes a plurality of inwardly extending flexible projections 24 which are configured to coact with the finish of the container C during removal of the closure from the container. The pilfer band 22 is distinguished from the skirt portion 16 of the closure by a circumferentially extending score line 26 which extends through the side wall portion of the closure cap. The pilfer band 22 is at least partially detachably connected to the skirt portion 16 by a plurality of circumferentially spaced frangible bridges 28 which extend between the inside surfaces of the skirt portion and the pilfer band. A tamper-evident feature such as illustrated can be formed in accordance with the teachings of U.S. Pat. No. 4,418,828. Alternately, a pilfer band may be configured in accordance with the teachings of U.S. Pat. No. 4,938,370.

Composite closure 10 is composite in nature in that it includes the outer closure cap 12, and a sealing liner 30 which is preferably compression-molded in position in the closure cap 12. The sealing liner is configured to create a so-called "top/side seal" in association with the container C. Such a seal effects sealing engagement with both the generally upwardly facing surface of the container C, as well as with the generally outwardly facing surface thereof. This type of seal has proven particularly effective with containers having carbonated contents, since even though internal gas pressure (acting against the inside top surface of the closure) can affect the sealing engagement of the liner at the top of the container, the sealing integrity of the arrangement at the side of the container is maintained.

To provide this type of sealing arrangement, the sealing liner 30 includes a generally disc-shaped central portion 32, and an integral, relatively thick annular sealing bead portion 34. The sealing bead portion 34 defines a generally vertical, generally inwardly facing sealing surface 36 which effects the side seal of the closure, with the central portion 32 providing the desired top seal.

Figure 2:
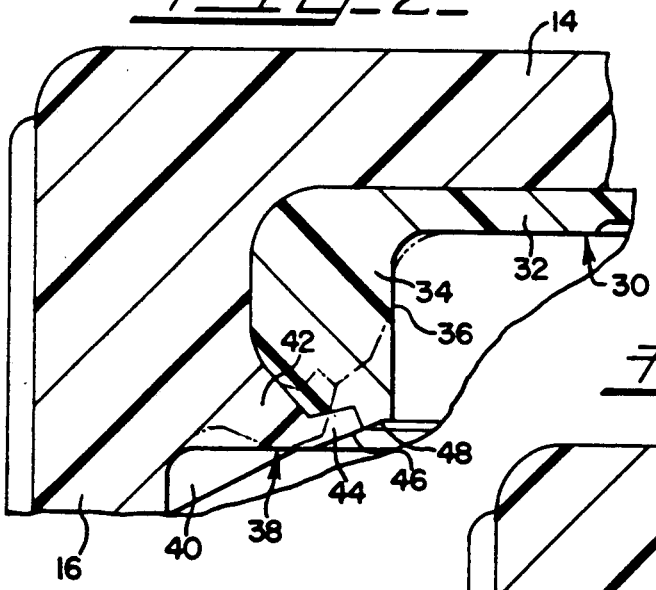
FIG. 2 is a fragmentary, relatively enlarged view illustrating the side seal proportioning lip of the present composite closure.

In accordance with the present invention, the closure cap 12 includes an annular liner-retaining lip 38 which projects inwardly from the annular skirt portion 16 of the closure in closely spaced relation to the top wall portion 14. A plurality of circumferentially spaced gussets 40 can be provided extending between the skirt portion 16 and the annular lip to enhance the rigidity of the base portion of the annular lip 38. As will be further described, annular lip 38 has been particularly configured in accordance with the principles of the present invention to provide a self-adjusting or proportioning action by deforming the sealing liner 30 (as generally illustrated in phantom line in FIG. 2), whereby the degree of sealing effected by the inwardly facing side seal surface 36 is automatically varied when fitted to containers having varying dimensions.

As noted, the present type of closure has proven effective on containers having carbonated contents, in part because the construction can accommodate the normal manufacturing tolerances which result in varying dimensions for containers to which the closures are fitted. Ordinarily, such varying dimensions are accommodated by subjecting the sealing liner of the closure to either a lesser or greater degree of compression during application. Application is facilitated by the formation of a frusto-conical surface on the sealing liner which extends between its inwardly facing sealing surface and the associated annular lip.

The closure of the present invention is configured to further enhance the performance of this type of closure when fitted to containers exhibiting normal manufacturing dimensional tolerances. To this end, the annular lip 38 has been specifically configured in a generally compound configuration, including a relatively rigid and inflexible base portion 42 adjacent the skirt portion of the closure, and a relatively flexible inner edge portion 44 extending inwardly of the base portion 42.

The inner edge portion 44 is relatively thinner in cross-section than the base portion 42, and has a generally inwardly tapering or converging shape. By virtue of the rigidification of the base portion 42 by the gussets 40, the inner portion 44 tends to flex and deform, relative to the base portion, generally at the inner junctions of the gussets with the lip 38. Thus, in the illustrated construction including gussets 40, the flexible inner portion 44 of the lip 38 is generally defined as that portion of the lip extending inwardly of the gussets.

In the preferred form, the inner edge portion 44 defines a frusto-conical guide surface 46 (FIGS. 2, 3) which faces generally away from the top wall portion 14 of the closure cap, and converges inwardly toward the top wall portion. Most preferably, the sealing liner 30 includes a frusto-conical annular guide surface 48 (FIG. 2) which also converges inwardly toward the top wall portion and is preferably configured generally as a continuation of the annular guide surface 46, whereby the guide surface 46 and the guide surface 48 collectively define a frusto-conical surface.

Figure 3:
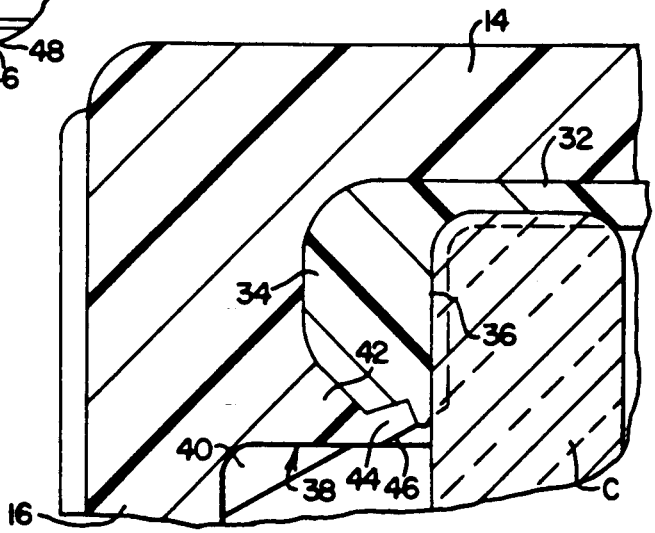
FIGS. 3 and 4 are views similar to FIG. 2 illustrating the manner in which the seal proportioning lip of the present construction cooperates with containers having varying dimensions.
Figure 4:
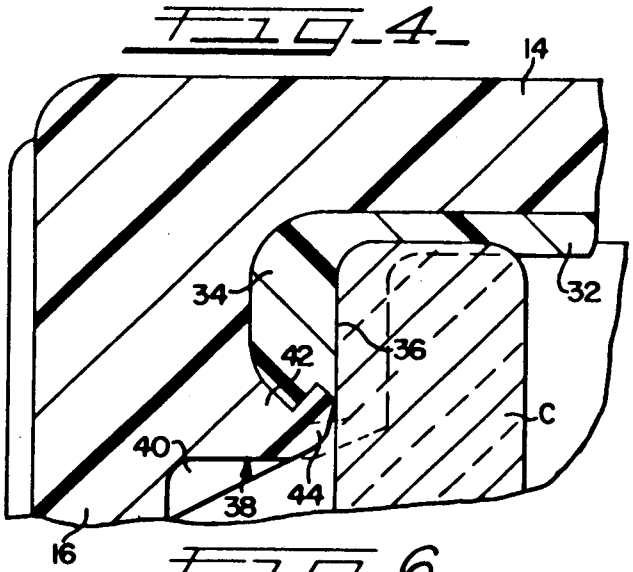

The self-adjusting and proportioning action of the present sealing construction is illustrated in FIGS. 3 and 4. In FIG. 3, the present closure is illustrated being fitted to a container C having a relatively small outside diameter, with the original configuration of the sealing liner 30 being illustrated in phantom line.

As will be observed, the relatively low degree of interference between the relatively small container and the sealing liner 30 results in relatively light compression of the liner at both its top and side sealing regions. In view of this, it is preferred that a relatively long (referring to the axial extent) side seal be formed. This is achieved since the annular lip 38 is dimensioned so that compression and deformation of the sealing liner 30 takes place with little or no engagement of the container with the annular lip 38, and thus little or no deformation of the liner by deflection of edge portion 44.

FIG. 4 illustrates the manner in which the present closure acts to proportion the degree of sealing engagement of the inwardly facing sealing surface 36 of the liner 30 with a container having a relatively large outside diameter. Again, the original disposition of the sealing liner (and annular lip) are illustrated in phantom line.

In view of the relatively high degree of interference which is created between this large container and the sealing liner, it is preferred that a relatively short seal length be created between the inwardly facing surface 36 and the outwardly facing surface of the container. This is achieved by the coaction of the container with the relatively flexible outer edge portion 44 of the annular lip 38, which in turn acts to shape and deform the annular sealing bead portion 34 of the liner 30.

Figure 5:
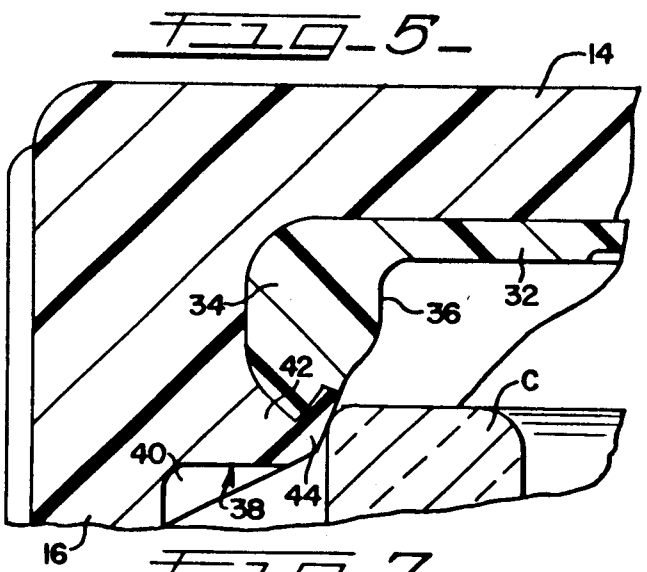
FIG. 5 is a view similar to FIG. 2 illustrating the manner in which the seal proportioning lip of the present construction facilitates high-speed closure application, particularly to a relatively large container.
Figure 6:
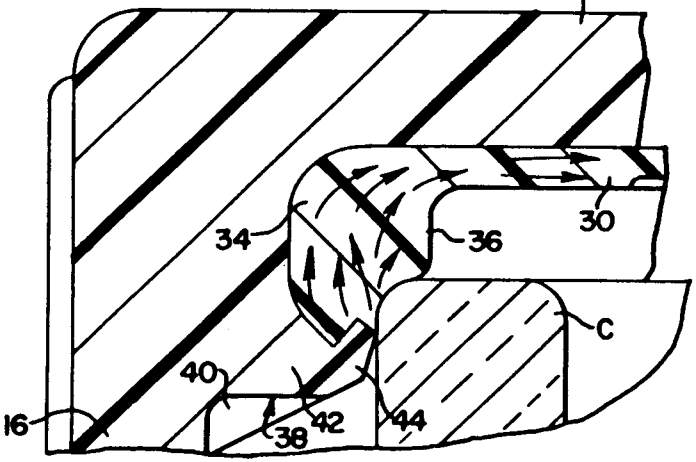
FIG. 6 is a view similar to FIG. 5 further illustrating application of the present closure to a relatively large container.

Specifically, and as illustrated in FIGS. 5 and 6, application of the closure to this relatively large container results in engagement of the container with the relatively flexible outer portion 44 of the annular lip, which in turn initiates compression and deformation of the liner prior to engagement of the liner with the container. By this action, the side sealing surface at 36 is effectively shortened, with compression of the liner by both the annular lip and the container acting to force the lining material toward the center of the closure. The eventual result is illustrated in FIG. 4. It will be noted by comparison to FIG. 3, that the engagement of the inwardly facing surface 36 is significantly less with the relatively large container of FIG. 4 than with the relatively small container of FIG. 3.

Several other advantages provided by the present sealing construction should be noted in FIGS. 4–6. The preferred provision of annular guide surfaces 46 and 48 assist in guiding the closure into position for the desired sealing engagement with the container C. The guide surface 46 of the relatively flexible inner edge portion 44 of the annular lip desirably acts to compress and shape the liner as the closure is applied, with the preferred frusto-conical configuration providing the desired action.

In view of this action, a sufficiently large entrance angle for accommodating the relatively large container is automatically created at the sealing surface 36, thereby obviating the need to form the annular surface 48 of the liner with a steeply sloped configuration. Resort to relatively steeply angled lead-in surfaces on the liner can be counterproductive. A steep angle results in a relatively short, low compression side seal on a small container, and a relatively long, high compression seal on a large container, contrary to the desired effect, which is achieved with the present invention. The illustrated arrangement thus acts to assure the desired application and engagement, even though the physical interference and friction between the container and the closure may be relatively high.

As noted, the present construction functions such that during application to a relatively large container, the resultant high compression of the liner material acts to displace the liner material generally toward the center of the closure. The engagement between the relatively flexible inner edge portion of the annular lip 38 and the container desirably acts to provide a relatively tight hoop seal to confine the liner material in the region at which the side and top seals are intended to be formed. This arrangement desirably acts to abate and prevent any extrusion of the liner material downwardly between the annular lip and the container finish, which extrusion can sometimes occur in known constructions. Such extrusion can act to increase the degree of rotation which is required for releasing the seal of the closure (sometimes referred to as the vent release angle) thereby decreasing the degree of rotation between initiation of gas venting, and disengagement of thread formation 18 from the container threads. Since gas venting is preferably completed prior to disengagement of the threads, the present construction desirably acts to assure that venting is initiated when intended, thereby acting to assure completion of venting prior to thread disengagement.

A further advantage of the present construction concerns in situ liner formation. Liner formation is effected by depositing a molten pellet of liner-forming material in the closure cap, preferably with the top wall portion 14 positioned downwardly, with the liner material thereafter compressed to mold it to the configuration of the liner. During this process, a central liner-forming plunger is employed, with a concentric sleeve disposed thereabout for engagement with the annular lip of the closure.

Experience has shown that in current forms of the present type of composite closure, the outer closure cap is preferably cooled for a relatively extended period prior to in situ liner formation. Ordinarily, attempts at lining closure shells while they are still relatively hot from the molding operation can result in plastic flashing around the annular lip of the closure shell, which is believed to result from the lip being pliable and not sufficiently cool as to exhibit sufficient rigidity to resist the liner-forming pressures without undesired deformation.

Figure 7:
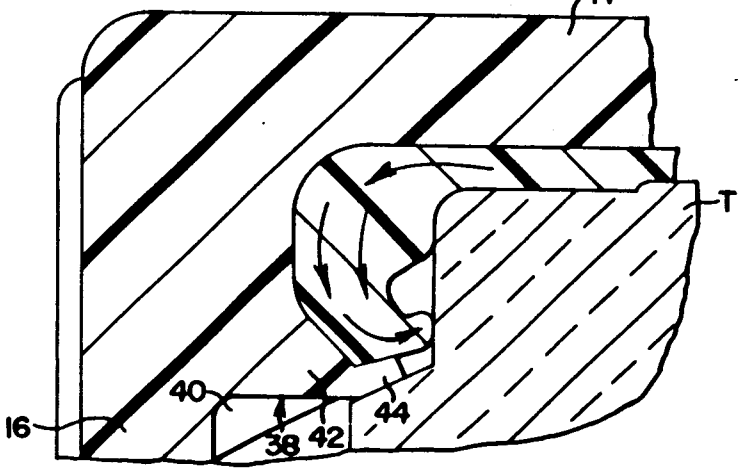
FIG. 7 is a fragmentary view illustrating formation of the present composite closure.

As illustrated in FIG. 7, the configuration of the present closure cap 12, including the compound annular lip 38, desirably addresses this problem by providing relatively greater surface area for the molding tooling T to seal against, with the lip acting to redirect the flow of molten liner material inwardly. It is believed that this causes some of the liner material to prematurely "freeze off" or solidify before the end of the liner-shaping process. The molten liner material following the solidified material meets with more resistance as it compresses toward the annular lip 38, and the associated liner forming tooling sealing surfaces. Thus, manufacturing efficiency is enhanced, since the need for an extended cooling period for the outer cap prior to lining is avoided.

From the foregoing, it will be observed that numerous modifications and variations can be effected without departing from the true spirit and scope of the novel concept of the present invention. No limitation with respect to the specific embodiment illustrated herein is intended or should be inferred. The disclosure is intended to cover by the appended claims all such modifications as fall within the scope of the claims.

What is claimed is:

1. A composite closure for a container, comprising:

an outer closure cap having a top wall portion, an annular skirt portion depending from said top wall portion, and annular liner-retaining lip means projecting inwardly from said annular skirt portion in closely spaced relation to said top wall portion; and a sealing liner positioned adjacent said top wall portion and retained by said annular lip means, said sealing liner including an annular sealing bead portion positioned adjacent said annular lip means and having a generally inwardly facing sealing surface, said lip means defining an annular guide surface means facing generally away from said top wall portion for guiding said closure onto the associated container for sealing engagement of said inwardly facing sealing surface with the associated container, said sealing bead portion of said liner defining an annular surface extending between said annular guide surface means and the inwardly facing sealing surface of said bead portion, said guide surface means converging inwardly and upwardly toward said top wall portion, said annular surface of said sealing liner converging inwardly and upwardly toward said top wall portion and comprising a continuation of the inwardly converging annular guide surface means of said annular lip means to define a frusto-conical surface therewith.

2. A composite closure for a container, comprising:

an outer closure cap having a top wall portion, an annular skirt portion depending from said top wall portion, and annular liner-retaining lip means projecting inwardly from said annular skirt portion in closely spaced relation to said top wall portion; and a sealing liner positioned adjacent said top wall portion and retained by said annular lip means, said sealing liner including an annular sealing bead portion positioned adjacent said annular lip means and having a generally inwardly facing sealing surface, said lip means being deflectable to deform said annular sealing portion of said liner to thereby proportion the degree of sealing engagement of said inwardly facing sealing surface of said liner with the associated container, said annular lip means comprising a base portion positioned adjacent said skirt portion, and a relatively flexible and deflectable inner edge portion extending inwardly of said base portion, said inner edge portion being deflectable relative to said skirt portion upon engagement with the associated container for deforming said sealing bead portion of said liner, said annular lip means defining an annular guide surface facing generally away from said top wall portion, said guide surface converging inwardly and upwardly toward said top wall portion, and being engageable with the associated container.

3. A composite closure in accordance with claim 2, wherein said sealing bead portion of said liner defines an annular surface extending between said annular guide surface of said lip means and the inwardly facing sealing surface of said bead portion.

4. A composite closure in accordance with claim 2, wherein said inner edge portion of said lip means is relatively thinner than said base portion and has a generally inwardly tapering shape.

5. A composite closure in accordance with claim 2, including a plurality of circumferentially spaced gussets extending between said skirt portion and said annular lip means, said relatively flexible inner edge portion comprising that portion of said lip means extending inwardly of said gussets.

6. A composite closure for a container, comprising:

an outer closure cap having a top wall portion, an annular skirt portion depending from said top wall portion, and annular liner-retaining lip means projecting inwardly from said annular skirt portion in closely spaced relation to said top wall portion; and a sealing liner positioned adjacent said top wall portion and retained by said annular lip means, said sealing liner including an annular sealing bead portion positioned adjacent said annular lip means and having a generally inwardly facing sealing surface, said lip means being deflectable to deform said annular sealing portion of said liner to thereby proportion the degree of sealing engagement of said inwardly facing sealing surface of said liner with the associated container, said annular lip means comprising a base portion positioned adjacent said skirt portion, and a relatively flexible and deflectable inner edge portion extending inwardly of said base portion, said deflectable inner edge portion having an upwardly and inwardly converging annular surface facing generally toward said top wall portion and engaging said annular sealing bead portion of said liner, said inner edge portion being deflectable relative to said skirt portion upon engagement with the associated container for deforming said sealing bead portion of said liner.

7. A composite closure in accordance with claim 6, wherein said annular lip means defines an annular guide surface facing generally away from said top wall portion, said guide surface converging inwardly and upwardly toward said top wall portion, and being engageable with the associated container.

8. A composite closure in accordance with claim 7, wherein said sealing bead portion of said liner defines an annular surface extending between said annular guide surface of said lip means and the inwardly facing sealing surface of said bead portion.

9. A composite closure in accordance with claim 6, wherein said inner edge portion of said lip means is relatively thinner than said base portion and has a generally inwardly tapering shape.

10. A composite closure in accordance with claim 6, including a plurality of circumferentially spaced gussets extending between said skirt portion and said annular lip means, said relatively flexible inner edge portion comprising that portion of said lip means extending inwardly of said gussets.

* * * * *